US011268777B1

(12) United States Patent
Grant

(10) Patent No.: US 11,268,777 B1
(45) Date of Patent: Mar. 8, 2022

(54) SUPPRESSION DEVICE AND RELATED METHODS

(71) Applicant: Jeffrey S. Grant, Palm Bay, FL (US)

(72) Inventor: Jeffrey S. Grant, Palm Bay, FL (US)

( * ) Notice: Subject to any disclaimer, the term of this patent is extended or adjusted under 35 U.S.C. 154(b) by 265 days.

(21) Appl. No.: 16/372,295

(22) Filed: Apr. 1, 2019

Related U.S. Application Data

(60) Provisional application No. 62/782,467, filed on Dec. 20, 2018, provisional application No. 62/651,082, filed on Mar. 31, 2018.

(51) Int. Cl.

| | |
|---|---|
| ***F41A 21/30*** | (2006.01) |
| ***F01N 1/08*** | (2006.01) |
| ***F41A 21/36*** | (2006.01) |
| ***F41A 21/34*** | (2006.01) |

(52) U.S. Cl.
CPC ..... *F41A 21/30* (2013.01); *F01N 1/083* (2013.01); *F41A 21/34* (2013.01); *F41A 21/36* (2013.01)

(58) Field of Classification Search
CPC ..... F41A 21/30; F01N 1/083
See application file for complete search history.

(56) References Cited

U.S. PATENT DOCUMENTS

| | | | | |
|---|---|---|---|---|
| 1,017,003 A | | 2/1912 | Kenny | |
| 4,576,083 A | * | 3/1986 | Seberger, Jr. | F01N 1/08 181/223 |
| 5,029,512 A | * | 7/1991 | Latka | F41A 21/30 89/14.4 |
| 5,136,923 A | * | 8/1992 | Walsh, Jr. | F41A 21/30 89/14.2 |
| 5,659,158 A | * | 8/1997 | Browning | F01N 1/08 181/265 |
| 6,575,074 B1 | * | 6/2003 | Gaddini | F41A 21/30 89/14.4 |
| 8,100,224 B1 | * | 1/2012 | Olson | F41A 21/30 181/223 |
| 8,844,422 B1 | * | 9/2014 | Klett | F41A 21/30 89/14.2 |
| 8,875,612 B1 | * | 11/2014 | Klett | C22C 19/03 89/14.4 |
| 8,991,551 B2 | * | 3/2015 | Latka | F41A 21/30 181/223 |
| 9,239,201 B1 | * | 1/2016 | Reis Green | F41A 21/30 |
| 9,709,354 B2 | * | 7/2017 | Larue | F41A 21/325 |
| 9,739,296 B2 | * | 8/2017 | Schlosser | F02C 7/045 |
| 10,088,259 B2 | * | 10/2018 | Dueck | B23K 26/282 |
| 10,107,581 B2 | * | 10/2018 | Garst | F41A 21/30 |

(Continued)

OTHER PUBLICATIONS

PCT International Bureau; PCT International Search Report and Written Opinion dated Mar. 3, 2020; entire document.

*Primary Examiner* — Joshua T Semick
(74) *Attorney, Agent, or Firm* — Allen, Dyer, Doppelt & Gilchrist, P.A.

(57) ABSTRACT

Shockwave suppression is accomplished by channeling a shockwave from a shockwave source, such as a firearm, into a suppression device along a propagation path, and within the suppression device, deflecting a portion of the shockwave away from the firing axis, and channeling the deflected portion through a feedback path and back to a region behind the deflected shockwave. The suppression device can be formed from one more chambers arranged within an outer wall and including baffles and inner wall sections.

28 Claims, 4 Drawing Sheets

(56) References Cited

U.S. PATENT DOCUMENTS

| | | | | |
|---|---|---|---|---|
| 10,113,826 | B2 * | 10/2018 | Bray | F41A 21/34 |
| 10,281,228 | B1 * | 5/2019 | Marfione | F41A 21/30 |
| 10,746,491 | B2 * | 8/2020 | Garst | F41A 21/30 |
| 10,794,651 | B2 * | 10/2020 | Crown | F41A 21/30 |
| 2011/0297477 | A1 * | 12/2011 | Koumbis | F41A 21/30 181/223 |
| 2012/0152093 | A1 * | 6/2012 | Koumbis | F41A 21/30 89/14.4 |
| 2016/0209152 | A1 | 7/2016 | Dueck et al. | |
| 2017/0102202 | A1 | 4/2017 | Victor | |
| 2018/0135932 | A1 | 5/2018 | Tomczak | |
| 2021/0123364 | A1 * | 4/2021 | Baxter | F01N 1/06 |

* cited by examiner

SUPPRESSION DEVICE AND RELATED METHODS

CROSS-REFERENCE TO RELATED APPLICATION

This application claims the benefit of U.S. Provisional Patent Application Ser. No. 62/782,467, filed on Dec. 20, 2018, and U.S. Provisional Patent Application Ser. No. 62/651,082, filed on Mar. 31, 2018, the contents of which applications are herein incorporated by reference in their entirety.

FIELD OF THE INVENTION

The present invention relates to devices and methods for the reduction of noise, flash and recoil from the sudden release of gas or other fluid, and more particularly, to the reduction of noise, flash from the discharge of a firearm.

BACKGROUND OF THE INVENTION

A shockwave has a sharp change of pressure in a narrow region traveling through a medium, especially air. In a firearm application, the shockwave is the result of gas exceeding the speed of sound. Typical devices designed to suppress firearms are composed of a series of baffles. The size and shape of the baffles vary greatly. They are generally designed to obstruct the forward flow of the gas. While existing suppression devices are useful, further improvements are possible.

SUMMARY OF THE INVENTION

In view of the foregoing background, it is therefore an object of the present invention to provide improved suppression devices and related methods for controlling the release of fluid flows exhibiting shockwaves.

According to an embodiment of the present invention, a firearm suppression device comprises an outer wall extending around a propagation path between outer wall inlet and outlet ends an outer wall extending around a propagation path between outer wall inlet and outlet ends, one or more baffles extending inwardly from the outer wall toward the propagation path between the outer wall inlet and outlet ends, and one or more inner wall sections corresponding to the baffles and extending around the propagation path inwardly of the outer wall and outwardly of the baffle opening of the corresponding one of the plurality of baffles such that a circumferential volume is defined between the outer wall and the at least one inner wall section.

Each baffle defines a baffle opening between a baffle inlet face and a baffle outlet face through which the propagation path passes, and is preferably angled toward the outer wall inlet end from the outer wall. Each inner wall section extends around the propagation path inwardly of the outer wall and outwardly of the baffle opening of the corresponding one of the baffles such that a circumferential volume is defined between the outer wall and the inner wall section. Each inner wall section extends from the corresponding baffle toward the outer wall inlet end between inner wall section first and second ends, and adjoins the baffle inlet face of the corresponding baffle at the first end.

First and second fluid flow paths are defined through the inner wall section first and second ends, respectively, that communicate with the circumferential volume. A portion of fluid propagating along the propagation path will be deflected by the baffle inlet face of the baffle through the first fluid flow path into the circumferential volume, and out the second fluid path back toward the propagation path.

According to a method aspect, a method of shockwave suppression includes channeling a shockwave from a muzzle of the firearm (or other shockwave source) into a suppression device along a firing axis (or other propagation path), and within the suppression device, deflecting a portion of the shockwave away from the firing axis, and channeling the deflected portion through a feedback path and back to a region behind the deflected shockwave.

These and other objects, aspects and advantages of the present invention will be better appreciated in view of the drawings, and following detailed description of preferred embodiments.

DETAILED DESCRIPTION OF PREFERRED EMBODIMENTS

Figure 1:
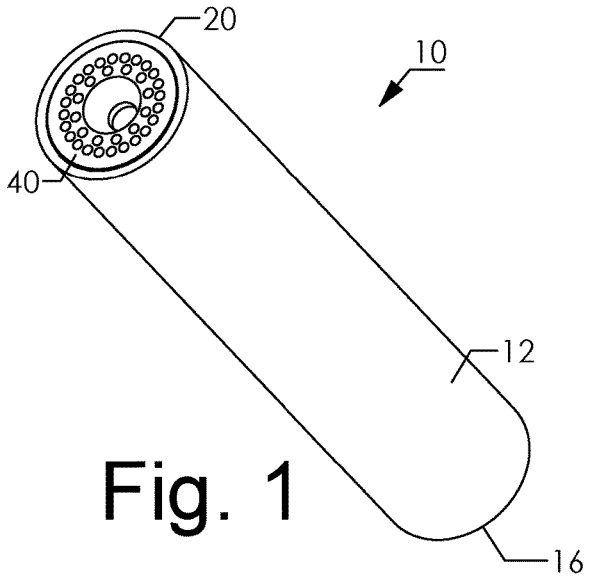
FIG. 1 is a perspective view of a suppression device according to an embodiment of the present invention, from an outlet end thereof.
Figure 3:
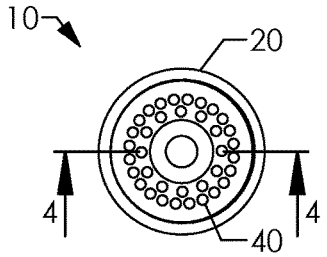
FIG. 3 is an outlet end view of the suppression device of FIG. 1.
Figure 2:
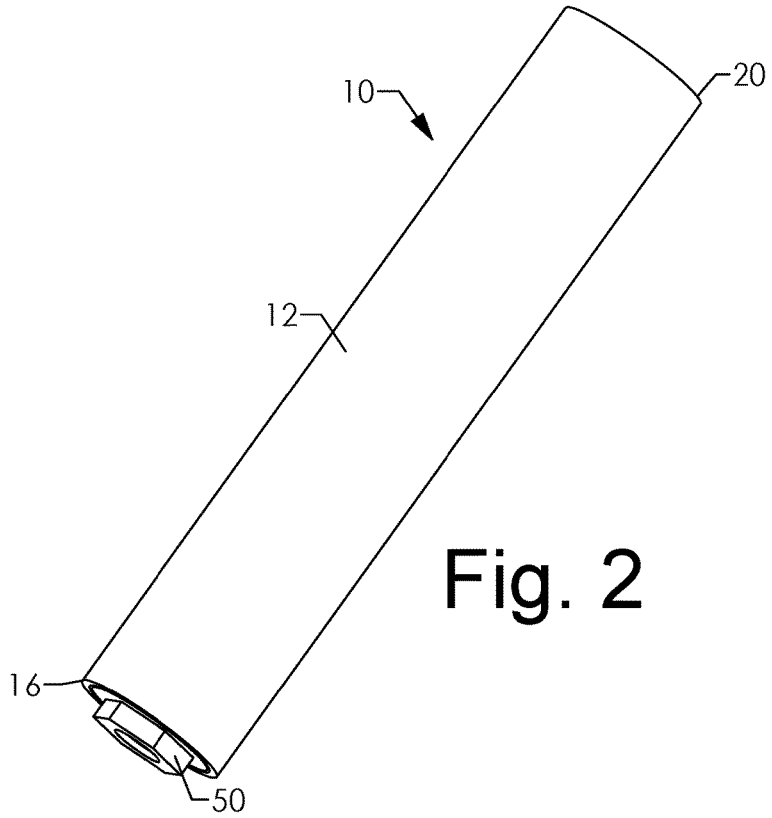
FIG. 2 is a perspective view of the suppression device of FIG. 1, from an inlet end thereof.

According to an embodiment of the present invention, referring to FIGS. 1-4, a suppression device 10 includes an outer wall 12 extending around a propagation path 14 between inlet and outlet ends 16, 20. In a firearms application, the inlet end 16 is configured for attachment to the muzzle of a firearm, such that the propagation path is collinear with the firing axis. A plurality of baffles 22A, 22B extend inwardly from the outer wall 12 toward the propagation path 14. Each of the baffles 22A, 22B defines a baffle opening 24A, 24B through which the propagation path 14 passes.

A plurality of inner wall sections 26 extend from respective ones of the baffles 22A, 22B toward the inlet end 16 around the propagation path 14 inwardly of the outer wall 12 such that a plurality of circumferential volumes 28 are defined. First and second fluid flow paths 30, 32 extend through each inner wall section 26 at first and second ends thereof 34, 36. As will be explained in greater detail below, a portion of the fluid propagating along the propagation path (i.e., as part of a shockwave) will be deflected by each baffle 22A, 22B, through the first fluid flow paths 30 into the circumferential volumes 28 and out of the second fluid flow paths 32 back toward the propagation path 14.

Figure 5:
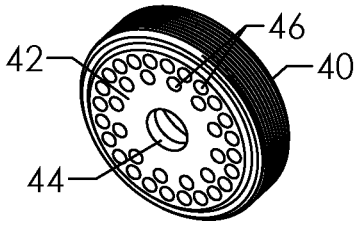
FIG. 5 is a perspective view of a diffuser of the suppression device of FIG. 1.

Referring also to FIG. 5, a diffuser 40 is arranged at the outlet end 20 of the outer wall 12. The diffuser 40 includes a outlet plate 42 defining an exit opening 44 concentric with the propagation path 14, which has an inner diameter preferably less than or equal to the diameter of the adjacent baffle opening 24B. A plurality of vent openings 46 are defined around the exit opening 44. In a firearms application, the projectile exits through the exit opening 44 after passing through the aligned baffle openings 24A, 24B. Preferably, the diffuser 40 threads into the outlet end 20.

Figure 6:
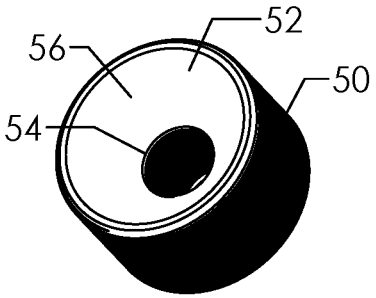
FIG. 6 is a perspective view of a muzzle connector of the suppression device of FIG. 1.
Figure 7:
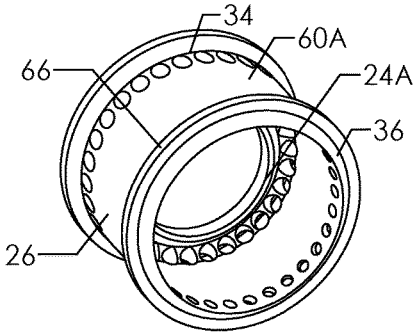
FIG. 7 is a perspective view of a first type of chamber of the suppression device of FIG. 1, from an inlet end thereof.
Figure 8:
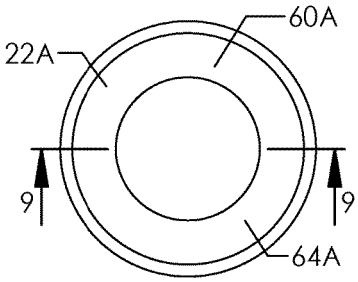
FIG. 8 is an outlet end view of the chamber of FIG. 7.
Figure 9:
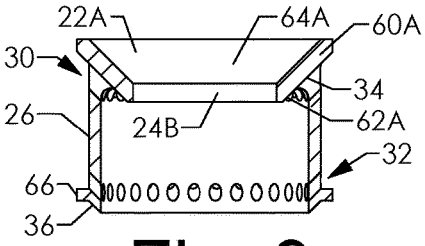
FIG. 9 is a cross-sectional view of the chamber of FIG. 7, taken along line 9-9 of FIG. 8.
Figure 12:
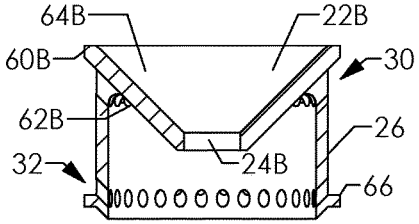
FIG. 12 is a cross-sectional view of the chamber of FIG. 10, taken along line 12-12 of FIG. 11.
Figure 11:
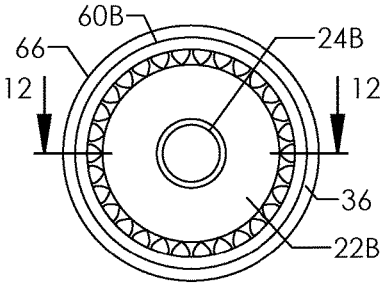
FIG. 11 is an inlet end view of the chamber of FIG. 10.
Figure 10:
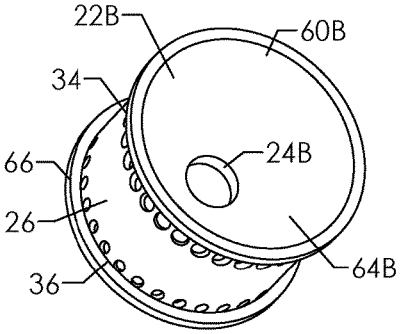
FIG. 10 is a perspective view of a second type of chamber of the suppression device of FIG. 1, from an outlet end thereof.

Referring also to FIG. 6, in the depicted embodiment, a firearm muzzle connector 50 is arranged at the outer wall inlet end 16. The muzzle connector 50 includes an inlet plate 52 defining a muzzle attachment opening 54 concentric with the propagation flow path 14 and the baffle openings 24A, 24B. The muzzle attachment opening 54 is threaded or otherwise configured for attachment to the muzzle of a firearm. Likewise, the muzzle connector 50, itself, threads into or otherwise connects to the inlet end 16. Preferably, an outlet face 56 of the inlet plate 52 is frustoconical surrounding the muzzle attachment opening 54, matching the angles of the baffles 22A, 22B.

Figure 4:
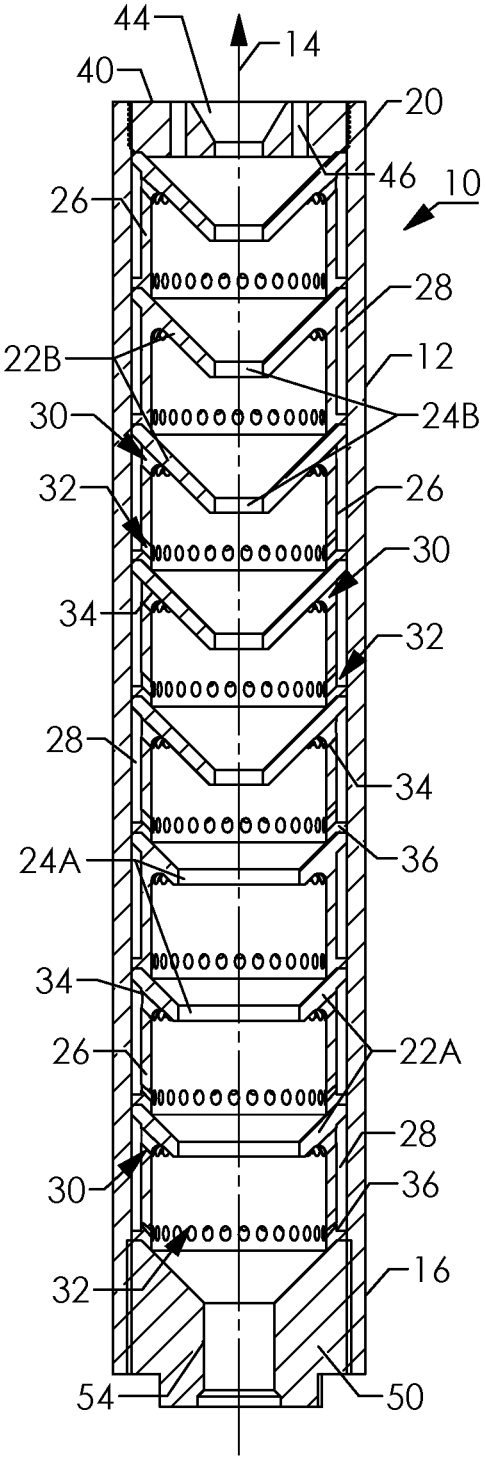
FIG. 4 is a cross-sectional view of the suppression device of FIG. 1, taken along line 4-4 of FIG. 3.

As appreciated from FIG. 4, each of the baffles 22A, 22B is angled from the outer wall 12 toward the outer wall inlet end 20. The baffles 22A, 22B are preferably evenly spaced along the propagation path 14, with the inner wall sections 26 consequently being equal in length. The baffles 22A with larger baffle openings 24A are advantageously arranged closer to the outer wall inlet end 16, and the baffles 22B with smaller baffle openings 24B are closer to the outlet end 20.

Although the baffle openings 24A, 24B are different diameters, the angle of each of the baffles 22A, 22B is preferably equal—and most preferably angled at 45 degrees. Each baffle 22A, 22B is advantageously frustoconical, with its baffle opening 24A, 24B being formed at the missing tip thereof.

Similarly, the fluid flow paths 30, 32 are angled toward the outlet wall inlet end 20 from the circumferential volume 28. Preferably, the angles of the first and second fluid flow paths 30, 32 equal the angles of the baffles 22A, 22B. In the depicted embodiment, each of the fluid flow paths 30, 32 is formed by a plurality of holes extending round their respective inner wall section first and second ends 34, 36. The diameters of the holes of the first fluid flow path 30 are preferably greater than the diameters of the holes of the second fluid flow path 32. The numbers of holes in the first and second flow paths 30, 32 is preferably equal.

Referring to FIGS. 7-12, each baffle 22A, 22B and its corresponding inner wall section 26 is advantageously formed as a unitary piece—the chambers 60A, 60B, each of which is separately removable from the outer wall 12. The first end 34 of the inner wall section 26 adjoins an inlet face 62A, 62B of the baffle 24A, 24B. The second end 36 is chamfered to match the conical profile of the outlet faces 64A, 64B (and of the outlet face 56 of the muzzle connector 50). Consequently, each chamber 60A, 60B is self-centering when inserted into the outer wall 12. To further improve radial stability of the chambers 60A, 60B and the seal between successive circumferential volumes 28 (see FIG. 4), an annular collar 66 can extend outwardly from each inner wall section second end 36.

Figure 13:
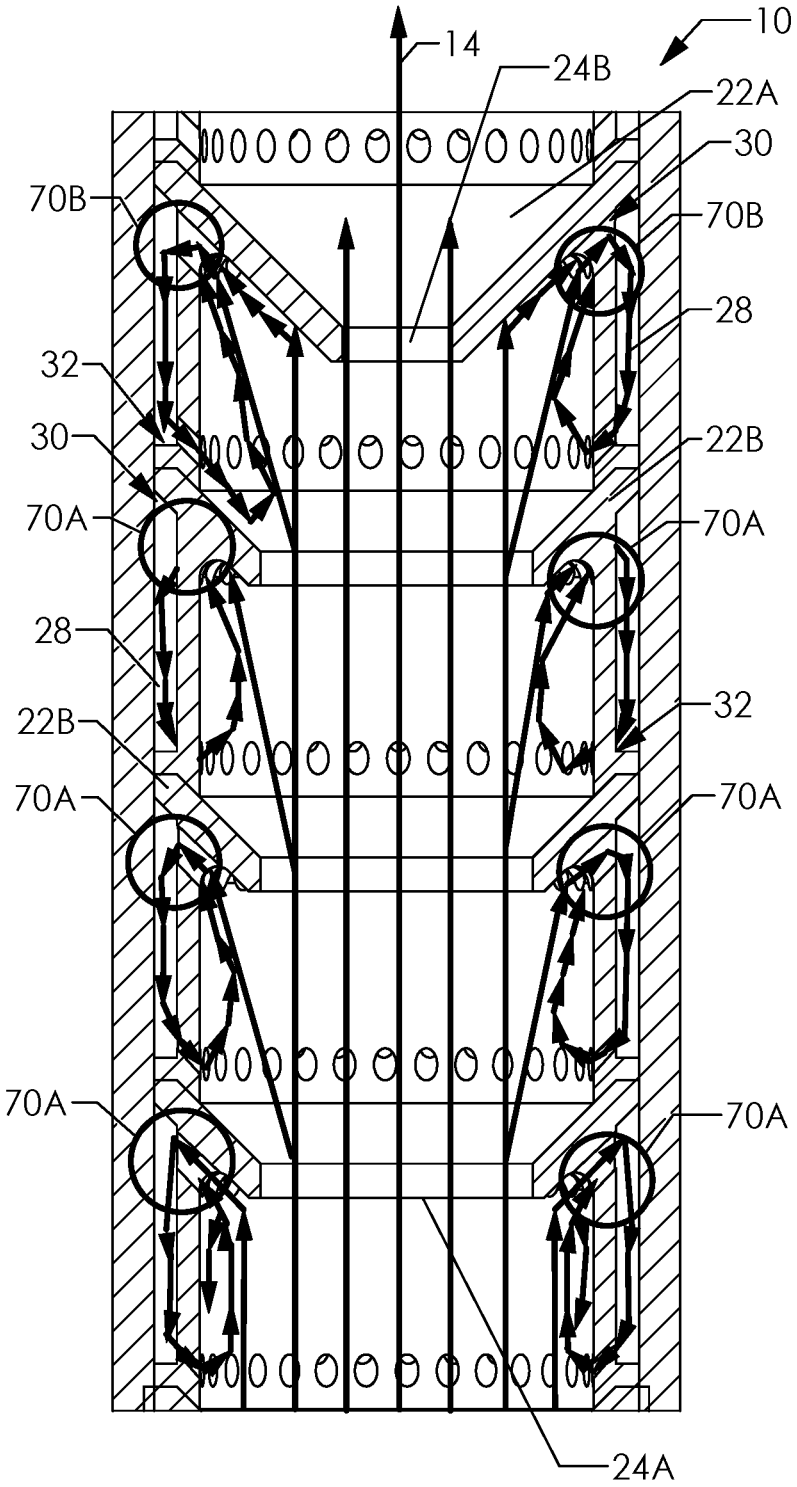
FIG. 13 is a detail view of a portion of the cross-sectional view of FIG. 4, including a feedback circulation established therein.

In operation, with reference to FIG. 13, a shockwave (represented by arrows) is channeled into the suppression device 10 generally along the propagation path 14 (e.g., the firing axis proceeding from the muzzle in a firearms application). Portions of the shockwave are slowed and deflected upon encountering each of the successive baffles 22A, with somewhat less of the shockwave passing through each opening 24A. A significantly greater portion of the shockwave is slowed and deflected upon reaching the larger baffles 22B with the smaller openings 24B.

At each baffle 22A, 22B, the high pressure side of the deflected shockwave enters a feedback path through the first fluid flow paths 30 at areas 70A, into the circumferential volume 28, and back out the second fluid flow path 32 to a lower pressure region behind the deflected shockwave. For as long as the shockwave persists, this feedback circulation continues—with successively decreasing force moving from the inlet end 16 to the outlet end 20. Preferably, the shockwave is dissipated until fluid flow velocity is at or below subsonic levels. By using the baffles 22A with the larger openings 24A first, additional volume for shockwave expansion is permitted, helping to prevent the development of an unsafe overpressure condition near the inlet end 16.

In general, the spacing between baffles should be long enough so that the pressure building up at the first fluid flow path 30 begins driving feedback circulation before the pressure at the second fluid flow path 32 counters the desired circulation. However, excessive baffle spacing can delay initiation of feedback circulation such that its impact on the overall dissipation of the shockwave is decreased. The use of larger holes for the first fluid flow path 30 relative to the second fluid flow path 32 helps facilitate initiation and maintenance of the desired feedback flow. Additionally, the use of equal numbers of holes at the same circumferential positions helps achieve a symmetrical reflow of fluid along the feedback path.

It will be appreciated that devices and methods according to the present invention advantageously provide a feedback path from the high pressure area of a shock wave to the low pressure area following the shockwave. This action advantageously slows the flow of fluids exhibiting a shockwave, dissipates energy in the fluid flow exhibiting the shockwave, reduces the noise of a high pressure fluid release, delays the release of the fluid, and provides time for the escaping fluid to cool.

The modular nature of the depicted suppressor device 10, employing an outer wall 12 with separate chambers 60A, 60B is advantageous with respect to design, manufacture and maintenance. Depending on the desired suppression parameters, any number and combination of chambers 60A, 60B, can be arranged within a suitably dimensioned outer wall. Depending on the desired application of the suppressor device, the inlet and/or outlet ends can be equipped with various fittings, couplers, quick disconnects, terminators or the like.

Alternatively, however, a suppressor device could be made within the scope of the present invention in which some or all of the baffles and/or inner wall sections could be formed integrally with the outer wall. Additionally, while the depicted outer wall 12 and chambers 60A, 60B are generally cylindrical, the present invention does not necessarily require this. Other outer wall and chamber geometries, including rectangular/square cross-sections, oval cross-sections and even varying cross-sections could also be advantageously employed.

In the depicted embodiment, the baffle openings 24A, 24B are aligned along a central axis of the outer wall 12. The present invention could include baffle openings aligned along some other common axis within the outer wall. Additionally, in applications where a solid projectile is not required to pass through the baffle openings, configurations could potentially be used where a strict collinear arrangement of openings is not employed. Moreover, the size, shape, angle, number and pattern of fluid flow path openings can be varied.

In general, the foregoing embodiments are described for illustrative and exemplary purposes; the present invention is not necessarily limited thereto. Rather, those skilled in the art will appreciate that various modifications, as well as adaptations to particular circumstances, will fall within the scope of the invention as herein shown and described and of the claims appended hereto.

What is claimed is:

1. A firearm suppression device comprising:

an outer wall extending around a propagation path between outer wall inlet and outlet ends;

at least one baffle extending inwardly from the outer wall toward the propagation path between the outer wall inlet and outlet ends, the at least one baffle defining a baffle opening between a baffle inlet face and a baffle outlet face through which the propagation path passes; and at least one inner wall section extending around the propagation path inwardly of the outer wall and outwardly of the baffle opening such that a circumferential volume is defined between the outer wall and the at least one inner wall section, the at least one inner wall section extending from the at least one baffle toward the outer wall inlet end between inner wall section first and second ends, the inner wall section first end adjoining the baffle inlet face, first and second fluid flow paths communicating with the circumferential volume being defined through the inner wall section first and second end, respectively, such that a portion of fluid propagating along the propagation path will be deflected by the baffle inlet face through the first fluid flow path into the circumferential volume, and out the second fluid path back toward the propagation path;

wherein the at least one baffle is angled toward the outer wall inlet end from the outer wall; and wherein the first and second fluid flow paths are both angled from the circumferential volume toward the outer wall inlet end.

2. The suppression device of claim 1, wherein a firearm muzzle connector is arranged at the outer wall inlet end, the firearm muzzle connector including an inlet plate defining muzzle attachment opening concentric with the propagation path and the baffle opening of the at least one baffle.

3. The suppression device of claim 1, wherein a diffuser is arranged at the outer wall outlet end, the diffuser including an outlet plate defining an exit opening concentric with the propagation path and the baffle opening of the at least one baffle.

4. The suppression device of claim 3, wherein a diameter of the exit opening is less than or equal to a diameter of the baffle opening.

5. The suppression device of claim 3, wherein the outlet plate further defines a plurality of vent openings around the exit opening.

6. The suppression device of claim 1, wherein the at least one baffle is angled toward the outer wall inlet end from the outer wall.

7. The suppression device of claim 6, wherein the at least one baffle is frustoconical with the baffle opening formed at a missing tip thereof.

8. The suppression device of claim 6, wherein the first fluid flow path is angled from the circumferential volume toward the outer wall inlet end.

9. The suppression device of claim 6, wherein the second fluid flow path is angled from the circumferential volume toward the outer wall inlet end.

10. The suppression device of claim 6, wherein the first and second fluid flow paths are both angled from the circumferential volume toward the outer wall inlet end.

11. The suppression device of claim 10, wherein the first and second fluid flow paths are both angled from the circumferential volume toward the outer wall inlet end at an angle equal to that of the at least one baffle.

12. The suppression device of claim 11, wherein the at least one baffle is angled 45 degrees toward the outer wall inlet.

13. The suppression device of claim 1, wherein the first and second fluid flow paths comprise respective first and second pluralities of flow holes.

14. The suppression device of claim 13, wherein diameters of the first plurality of flow holes are greater than diameters of the second plurality of flow holes.

15. The suppression device of claim 1, wherein the at least one baffle comprises a plurality of baffles, each of the plurality of baffles extending inwardly from the outer wall toward the propagation path between the outer wall inlet and outlet ends, and each of the plurality of baffles defining a baffle opening between a baffle inlet face and a baffle outlet face through which the propagation path passes; and wherein the at least one inner wall section comprises a plurality of inner wall sections, each of the plurality of inner wall sections corresponding to one of the plurality of baffles, each of the plurality of inner wall sections extending around the propagation path inwardly of the outer wall and outwardly of the baffle opening of the corresponding one of the plurality of baffles such that a circumferential volume is defined between the outer wall and the at least one inner wall section, each of the plurality of inner wall sections extending from the corresponding one of the plurality of baffles toward the outer wall inlet end between inner wall section first and second ends, the inner wall section first end adjoining the baffle inlet face of the corresponding one of the plurality of baffles, first and second fluid flow paths communicating with the circumferential volume being defined through the inner wall section first and second end, respectively, such that a portion of fluid propagating along the propagation path will be deflected by the baffle inlet face of the corresponding one of the plurality of baffles through the first fluid flow path into the circumferential volume, and out the second fluid path back toward the propagation path.

16. The suppression device of claim 1, wherein a diameter of the baffle openings of a first portion of the plurality of baffles more proximate to the outer wall inlet end is larger than a diameter of the baffle openings of a second portion of the plurality of baffles more proximate to the outer wall outlet end.

17. The suppression device of claim 15, wherein each of the plurality of inner wall sections forms a unitary piece with the corresponding one of the plurality of baffles.

18. The suppression device of claim 17, wherein each of the unitary pieces is separately removable from the outer wall.

19. The suppression device of claim 18, wherein each of the plurality of baffles is frustoconical with the baffle opening formed at a missing tip thereof located more proximate to the outer wall inlet opening, an angle of each of the plurality of baffles toward the outer wall inlet opening being equal; and wherein the inner wall section second end of each of the plurality of inner walls includes a chamfered edge matching the angle of each of the plurality of baffles toward the outer wall inlet opening.

20. A suppression device comprising:

an outer wall extending around a propagation path between outer wall inlet and outlet ends;

a plurality of baffles, each of the plurality of baffles extending inwardly from the outer wall toward the propagation path between the outer wall inlet and outlet ends, defining a baffle opening between a baffle inlet face and a baffle outlet face through which the propagation path passes, and being angled toward the outer wall inlet end from the outer wall;

a plurality of inner wall sections, each of the plurality of inner wall sections corresponding to one of the plurality of baffles, each of the plurality of inner wall sections extending around the propagation path inwardly of the outer wall and outwardly of the baffle opening of the corresponding one of the plurality of baffles such that a circumferential volume is defined between the outer wall and the at least one inner wall section, each of the plurality of inner wall sections extending from the corresponding one of the plurality of baffles toward the outer wall inlet end between inner wall section first and second ends, the inner wall section first end adjoining the baffle inlet face of the corresponding one of the plurality of baffles, first and second fluid flow paths communicating with the circumferential volume being defined through the inner wall section first and second end, respectively, such that a portion of fluid propagating along the propagation path will be deflected by the baffle inlet face of the corresponding one of the plurality of baffles through the first fluid flow path into the circumferential volume, and out the second fluid path back toward the propagation path; and a firearm muzzle connector arranged at the outer wall inlet end, the firearm muzzle connector including an inlet plate defining muzzle attachment opening concentric with the propagation flow path and the baffle openings of the plurality of baffles.

21. The suppression device of claim 20, wherein the first and second fluid flow paths of each of the plurality of inner wall sections are both angled from the circumferential volume toward the outer wall inlet end at an angle equal to that of the plurality of baffles.

22. The suppression device of claim 21, wherein the plurality of baffles are angled 45 degrees toward the outer wall inlet.

23. The suppression device of claim 22, wherein each of the plurality of baffles is frustoconical with the baffle opening formed at a missing tip thereof located more proximate to the outer wall inlet opening.

24. The suppression device of claim 23, wherein each of the plurality of inner wall sections forms a unitary piece with the corresponding one of the plurality of baffles and is separately removable from the outer wall.

25. The suppression device of claim 24, wherein a diameter of the baffle openings of a first portion of the plurality of baffles more proximate to the outer wall inlet end is larger than a diameter of the baffle openings of a second portion of the plurality of baffles more proximate to the outer wall outlet end.

26. A method of suppressing a firearm, the method comprising: channeling a shockwave from a muzzle of the firearm into a suppression device along a firing axis; and within the suppression device, deflecting a portion of the shockwave away from the firing axis, and channeling the deflected portion rearwardly through a feedback path and inwardly back to a region behind the deflected shockwave, wherein the suppression device includes a plurality of chambers arranged along the firing axis, and deflecting the portion of the shockwave away from the firing axis, and channeling the deflected portion through the feedback path and back to the region behind the deflected shockwave is performed successively in each chamber.

27. The method of claim 26, wherein, in each of the plurality of chambers, deflecting the portion of the shockwave away from the firing axis is performed by a baffle surrounding a baffle opening concentric opening and angled toward an inlet of the suppression device.

28. The method of claim 27, wherein, in each of the plurality of chambers, channeling the deflected portion through the feedback path and back to the region behind the deflected shockwave includes channeling the deflected portion through a first fluid flow path formed through an inner wall section first end adjacent the baffle, passing the deflected portion through a circumferential volume between the inner wall section and an outer wall of the suppression device, and passing the deflected though a second fluid flow path formed through an inner wall section second end.

* * * * *